US007806024B1

(12) United States Patent
Kroesen

(10) Patent No.: US 7,806,024 B1
(45) Date of Patent: Oct. 5, 2010

(54) METHOD FOR MAKING SHOVEL

(75) Inventor: John Kroesen, Elizabethtown, PA (US)

(73) Assignee: Forest Hill Manufacturing, LLC, Leola, PA (US)

( * ) Notice: Subject to any disclaimer, the term of this patent is extended or adjusted under 35 U.S.C. 154(b) by 16 days.

(21) Appl. No.: 12/034,171

(22) Filed: Feb. 20, 2008

(51) Int. Cl.
*B21D 53/66* (2006.01)

(52) U.S. Cl. ..... 76/113; 76/101.1

(58) Field of Classification Search ..... 76/101.1, 76/113; 294/49, 54.5, 55
See application file for complete search history.

(56) References Cited

U.S. PATENT DOCUMENTS

| | | | | | |
|---|---|---|---|---|---|
| 208,258 | A * | 9/1878 | Myers | 403/241 |
| 268,669 | A * | 12/1882 | Heiser | 76/113 |
| 373,530 | A * | 11/1887 | Maynard | 72/339 |
| 455,587 | A * | 7/1891 | Wright | 29/415 |
| 685,183 | A * | 10/1901 | Skelton | 72/337 |
| 1,499,174 | A * | 6/1924 | Hokanson | 76/113 |
| 1,500,571 | A * | 7/1924 | Brandenburg | 148/647 |
| 1,556,200 | A * | 10/1925 | Brandenburg | 148/320 |
| 1,608,729 | A * | 11/1926 | Durell | 76/113 |
| 1,608,730 | A * | 11/1926 | Durell | 294/49 |
| 1,714,592 | A * | 5/1929 | Denning | 294/49 |
| 1,898,590 | A | 2/1933 | Milligan | |
| 4,198,883 | A * | 4/1980 | Miller | 76/101.1 |
| 4,373,371 | A * | 2/1983 | Liu | 72/374 |
| 4,655,494 | A * | 4/1987 | Eads et al. | 294/49 |
| 5,548,883 | A * | 8/1996 | Saijo et al. | 29/243.5 |
| 6,021,657 | A * | 2/2000 | Finn et al. | 72/307 |
| 6,250,867 | B1 * | 6/2001 | Gwyn et al. | 412/19 |
| 6,928,848 | B2 * | 8/2005 | Golovashchenko et al. | 72/322 |
| 7,533,554 | B2 * | 5/2009 | Cortese | 72/379.2 |

* cited by examiner

*Primary Examiner*—Jason Daniel Prone
*Assistant Examiner*—Jennifer Swinney
(74) *Attorney, Agent, or Firm*—Barley Snyder LLC

(57) ABSTRACT

A method of making a shovel includes the steps of providing a substantially flat blank with portions for forming a blade and a shank; folding an edge of the blank from an initial position away from a plane of a surface of the blank to form a bent portion on the portion of the blank that forms the blade; and pressing the blank to restore the bent portion to the initial position to form the blade. The edge of the shovel is substantially straight and free from warps after the blank is pressed.

14 Claims, 3 Drawing Sheets

FIG. 1
PRIOR ART
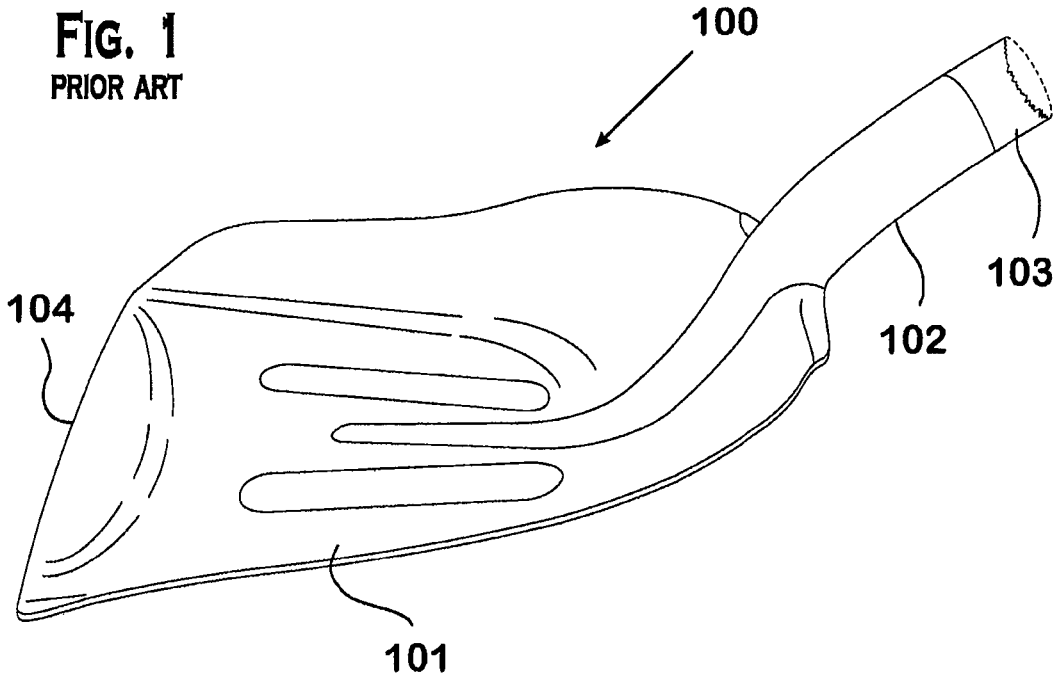
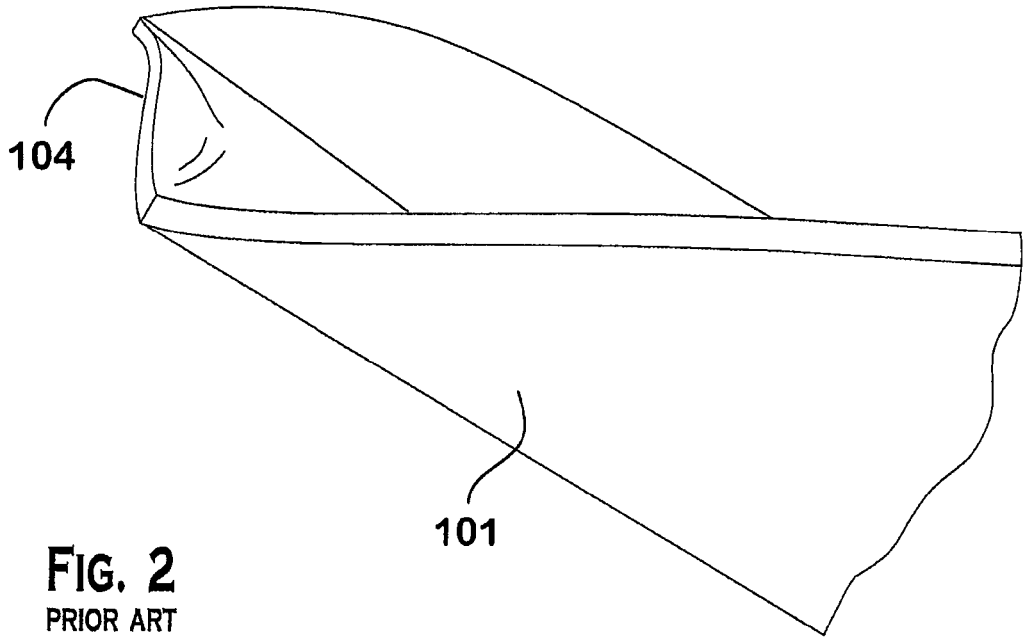
FIG. 2
PRIOR ART

FIG. 5
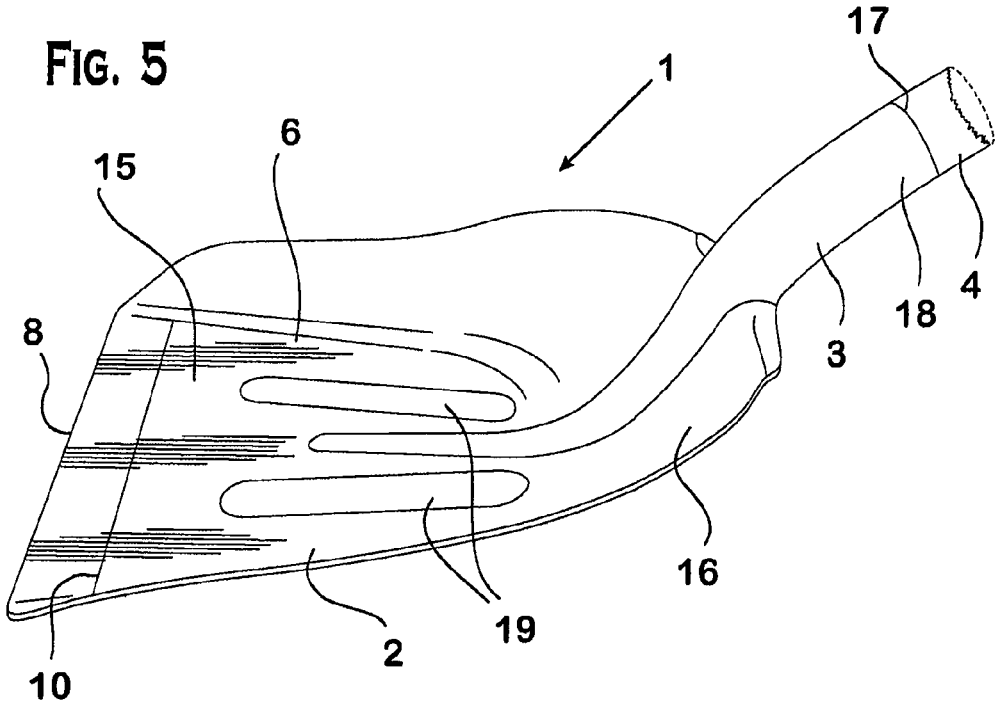
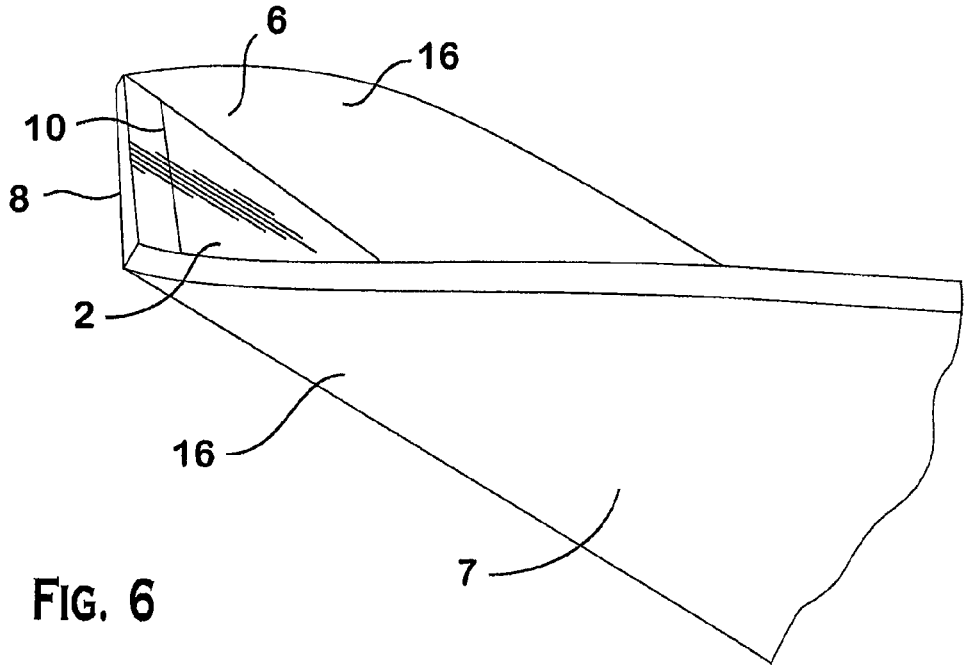
FIG. 6

METHOD FOR MAKING SHOVEL

FIELD OF THE INVENTION

The invention relates to a shovel and, more particularly, to a method for making the same.

BACKGROUND

FIGS. 1-2 show a shovel 100 according to the prior art. As shown in FIG. 1, the shovel 100 includes a blade 101, a shank 102, and a handle 103. The blade 2 and the shank 3 are integrally formed from a blank (not shown) consisting of a substantially T-shaped flat plate, which has been cut or stamped from a sheet of metal, such as aluminum. The blank (not shown) is then pressed, stamped, and/or formed to form the blade 101 and the shank 102. After the blade 101 and the shank 102 have been formed, the handle 103 is attached to the shank 102 to form the shovel 100.

The shovel 100 manufactured by the above-described method, however, is disadvantageous in that an edge 104 of the blade 101 that contacts the ground during use is substantially warped, as shown in FIG. 2. Because the edge 104 is warped, the shovel 100 is inefficient and difficult to operate.

SUMMARY

It is therefore an object of the present invention to provide a method of making a shovel wherein an edge of a blade of the shovel that contacts the ground during use is substantially warp free.

This and other objects are achieved by a method for making a shovel comprising the steps of providing a substantially flat blank with portions for forming a blade and a shank; folding an edge of the blank from an initial position away from a plane of a surface of the blank to form a bent portion on the portion of the blank that forms the blade; and pressing the blank to restore the bent portion to the initial position to form the blade.

BRIEF DESCRIPTION OF THE DRAWINGS

FIG. 1 is a perspective view of a shovel according to the prior art.

FIG. 2 is a perspective view of an edge of the shovel of FIG. 1.

FIG. 5 is a perspective view of the blank used to make the shovel of FIG. 3 shown after folding an edge thereof.

FIG. 6 is a perspective view of the edge of the shovel of FIG. 3.

DETAILED DESCRIPTION OF THE EMBODIMENT(S)

Figure 3:
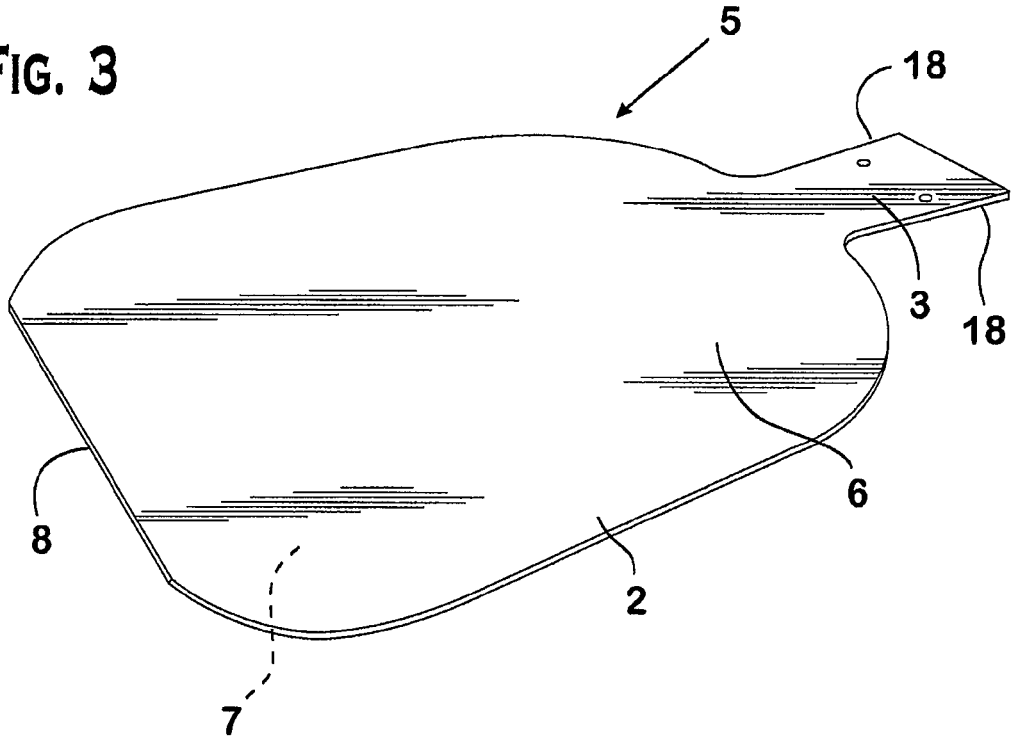
FIG. 3 is a perspective view of a shovel according to an embodiment of the invention.

FIGS. 3-6 show a shovel 1 and a method of making the same according to an embodiment of the invention. As shown in FIG. 5, the shovel 1 includes a blade 2, a shank 3, and a handle 4. The blade 2 consists of a substantially flat main surface 15. Substantially elongated support members 19 are provided in the substantially flat main surface 15. The substantially flat main surface 15 has a substantially straight edge 8 on one side thereof. Substantially arcuate side surfaces 16 extend from the remaining sides of the substantially flat main surface 15. The shank 3 extends at an angle from the substantially arcuate side surface 16 opposite the edge 8. The shank 3 has side walls 18 that form a socket 17. The handle 4, which is, for example, made from wood, is fixed in the socket 17.

The shovel 1 and a method of making the shovel 1 will now be described in greater detail. As shown in FIG. 3, the blade 2 and the shank 3 are integrally formed from a blank 5. The blank 5 consists of a substantially T-shaped flat plate, which has been cut or stamped from a sheet of metal, such as aluminum, stainless steel, carbon steel, or the like. The blank 5 has a top surface 6 and an opposing bottom surface 7. The blank 5 has a substantially uniform thickness between the top and bottom surfaces 6, 7 of about 0.060-0.150 inches, and preferably about 0.125 inches. On a side of the blade 2 opposite from the shank 3 is the edge 8. The blank 5 has a length extending from an end of the shank 3 to the edge 8 of about 28.25 inches. Although the blank 5 is shown and described herein as having the above dimensions, it will be appreciated by those skilled in the art that the dimensions of the blank 5 may be varied depending on the desired characteristics of the shovel 1.

Figure 4:
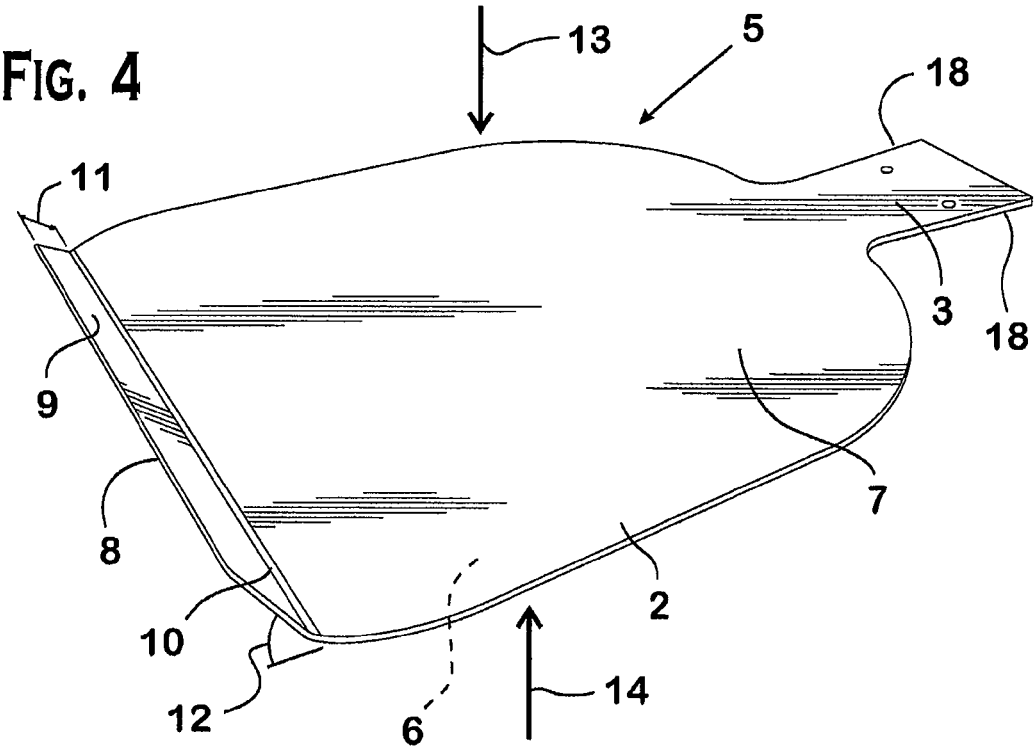
FIG. 4 is a perspective view of a blank used to make the shovel of FIG. 3.

As shown in FIG. 4, a bent portion 9 is formed in the blank 5. The bent portion 9 may be formed in the blank 5, for example, by bending the edge 8 of the blank 5 downward and away from a plane of the top surface 6 of the blank 5, for example, with a press (not shown), to form a crease 10. The crease 10 is formed at a distance 11 of about 1.5 inches from the edge 8 of the blank 5. The bent portion 9 is folded downward and away from the plane of the top surface 6 of the blank 5 to an angle 12 of less than about 90 degrees. It will be appreciated by those skilled in the art that although the bent portion 9 is described as being formed in the blank 5 by folding the edge 8 of the blank 5 downward and away from the plane of the top surface 6 of the blank 5 that alternatively the bent portion 9 could be formed in the blank 5 by folding the edge 8 of the blank 5 upward and away from a plane of the bottom surface 7 of the blank 5.

After the bent portion 9 is formed in the blank 5, the blank 5 is positioned in a die (not shown) in a pressing apparatus (not shown). The blank 5 may be positioned in the die (not shown) such that the bottom surface 7 of the blank 5 rests on the die (not shown) and the bent portion 9 extends downward toward the die (not shown). The die (not shown) has at least one substantially flat surface corresponding to the bent portion 9. A press (not shown) is actuated to press the blank 5 to form the substantially arcuate side surfaces 16, the support members 19, and the shank 3. During the pressing operation, the press (not shown) engages the crease 10 of the bent portion 9 and presses the crease 10 substantially in a direction of arrow 14, as shown in FIG. 4, onto the substantially flat surface of the die (not shown). The press (not shown) thereby restores the bent portion 9 to its initial position so that the blade 2 has a substantially flat main surface 15 that extends from the edge 8, as shown in FIG. 5.

Alternatively, the blank 5 may be positioned in the die (not shown) such that the top surface 6 of the blank 5 rests on the die (not shown) and the bent portion 9 extends upward away from the die (not shown). During the pressing operation, the press (not shown) engages the edge 8 of the bent portion 9 and presses the edge 8 substantially in a direction of arrow 13, as shown in FIG. 4, onto the substantially flat surface of the die (not shown). The press (not shown) thereby restores the bent portion 9 to its initial position so that the blade 2 has a substantially flat main surface 15 that extends from the edge 8, as shown in FIG. 5.

Because the pressing operation used to form the substantially arcuate side surfaces 16, the support members 19, and the shank 3 is well known in the art, further description thereof has been omitted. Additionally, it will be appreciated by those skilled in the art that the blade 2, the substantially arcuate side surfaces 16, the support members 19, and the shank 3 may be formed simultaneously in a single pressing operation or through multiple pressing operations. After the pressing operation is completed, the handle 4 is inserted into the socket 17 and clamped or otherwise fixed therein to form the shovel 1.

As shown in FIG. 6, as a result of bending the edge 8 out of the plane of the blank 5 prior to pressing the blank 5 into the shovel configuration and then restoring the edge to its initial position during pressing, the edge 8 is caused to be substantially perfectly straight and free from warps after pressing. Unlike the shovel 100 of the prior art, the edge 8 of the shovel 1 according to the invention therefore stays completely in contact with the ground during use so that it is efficient and easy to operate.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A method of making a shovel, comprising:

providing a substantially flat blank with portions for forming a blade and a shank;

folding an edge of the blank from an initial position away from a plane of a surface of the blank to form a bent portion on the portion of the blank that forms the blade; and pressing the blank to restore the bent portion to substantially the initial position to form the blade.

2. The method of claim 1, further comprising pressing the blank to form the shank simultaneously with forming the blade.

3. The method of claim 1, wherein a side of the blade opposite from the shank has the edge.

4. The method of claim 1, wherein the blank that is provided is substantially flat.

5. The method of claim 1, wherein the blank that is provided has a substantially uniform thickness.

6. The method of claim 1, wherein the blank that is provided is substantially T-shaped.

7. The method of claim 1, wherein the bent portion is folded away from the plane of the surface of the blank to an angle of less than about 90 degrees.

8. The method of claim 1, wherein the edge is substantially straight and free from warps after the blank is pressed.

9. The method of claim 1, wherein a crease is formed a distance of about 1.5 inches from the edge after folding.

10. The method of claim 1, wherein the blank is pressed from a top or a bottom surface thereof.

11. The method of claim 1, wherein the shank includes a socket.

12. The method of claim 1, further comprising fixing a handle in the shank.

13. The method of claim 1, wherein the blade has a substantially flat main surface that extends from the edge after pressing.

14. The method of claim 13, wherein the blade has substantially arcuate side surfaces that extend from the substantially flat main surface after pressing and the shank extends from the side surface opposite the edge.

* * * * *